US006040847A

United States Patent [19]

van Eekhout et al.

[11] Patent Number: 6,040,847

[45] Date of Patent: Mar. 21, 2000

[54] METHOD OF RECORDING IMAGES AND AN IMAGE-FORMING DEVICE FOR APPLICATION OF THE METHOD

[75] Inventors: Mike Paul van Eekhout; Pierre Antonius Marie Klerken; Robertus Petrus Cornelis Quirijnen, all of Venlo, Netherlands

[73] Assignee: OCE-Nederland B.V., Ma Venlo, Niger

[21] Appl. No.: 08/575,617

[22] Filed: Dec. 20, 1995

[30] Foreign Application Priority Data

Dec. 23, 1994 [NL] Netherlands ..... 9402196

[51] Int. Cl.[7] ..... B41J 2/39; B41J 2/395; B41J 2/40; B41J 2/06

[52] U.S. Cl. ..... 347/151; 347/55

[58] Field of Search ..... 347/55, 157, 139; 346/136; 399/168, 235, 241, 291, 293, 295, 310

[56] References Cited

U.S. PATENT DOCUMENTS 3,946,402 3/1976 Lunde ..... 347/55

FOREIGN PATENT DOCUMENTS 0191521 1/1986 European Pat. Off. .
0247694 5/1987 European Pat. Off. .
0247699 5/1987 European Pat. Off. .
0595388 10/1993 European Pat. Off. .
WO92/22911 12/1992 WIPO .

OTHER PUBLICATIONS

Patent Abstracts of Japan, vol. 016, No. 450 (M–1312), Sep. 18, 1992 & JP,A, 04 156351 (Casio Comput Co Ltd).
Patent Abstracts of Japan, vol. 012, No. 406 (P–777), Oct. 27, 1988 & JP,A,63 144364 (Canon Inc).

*Primary Examiner*—John Barlow
*Assistant Examiner*—Raquel Yvette Gordon
*Attorney, Agent, or Firm*—Birch, Stewart, Kolasch & Birch, LLP

[57] ABSTRACT

A method of and device for recording images on an image-recording medium with a dielectric surface. A voltage is applied in accordance with an image pattern between a set of image-recording electrodes and a companion electrode. Toner powder is deposited on the dielectric surface in accordance with the applied voltage. Image recording is effected by alternately bringing the image-forming electrodes to a positive and negative potential with respect to the companion electrode. According to one specific embodiment, a high-frequency AC voltage is applied during image recording to the companion electrode or at least the image-forming electrodes at times when the latter do not contribute to image forming.

13 Claims, 3 Drawing Sheets

METHOD OF RECORDING IMAGES AND AN IMAGE-FORMING DEVICE FOR APPLICATION OF THE METHOD

BACKGROUND OF THE INVENTION

Field of the Invention

The invention relates to a method of recording images on an image-recording medium intended for repeated use, the image-recording medium having a dielectric surface, wherein voltage is applied, in accordance with an image pattern to be recorded, between a set of image-recording electrodes and a companion electrode—one of the two (i.e. the set of image-recording electrodes or the companion electrode) being located beneath the dielectric surface and the other a predetermined distance above said surface. As a result of the voltage applied, toner powder in the space between the dielectric surface and the electrode disposed thereabove is deposited on the dielectric surface in accordance with the image pattern. The invention also relates to an image-forming device for the application of the method.

DESCRIPTION OF BACKGROUND ART

Image-forming methods and devices are described inter alia in European Patent Nos. 0191521, 0247694 and 0247699. A toner powder image is formed in an image-forming zone on the dielectric surface of an image-recording medium and is transferred directly, or indirectly via an intermediate medium, to a receiving material, such as plain paper, and fixed thereon. The image-recording medium is then used again for the next image-recording cycle.

With this type of image-forming device, it is of course essential that the life of the image-recording medium should be as long as possible. The continual mechanical, electrical and thermal loads on the image-recording medium gradually result in the deterioration thereof, and this is manifest in the form of a decline in the background-free base, i.e. the maximum potential difference between an image-recording electrode and the companion electrode at which toner deposition on the dielectric surface does not exceed a predetermined level. In practice, this level will be so fixed that no background is visible on the print.

The decline in the background-free base is the result of fouling which occurs as a result of the repeated stresses and change of electrical properties of the dielectric surface.

SUMMARY AND OBJECTS OF THE INVENTION

The invention relates to a method of the type described in the preamble, whereby it is possible to increase the life of the image-recording medium. The method according to the invention is characterized in that the image recording is effected by bringing the image-recording electrodes to a positive potential with respect to the companion electrode and then by bringing them to a negative potential with respect to the companion electrode. It has been found that the decline in the background-free base is appreciably delayed and hence the life of the image-recording medium is considerably lengthened, if the electrical field applied across the dielectric surface of the image-recording medium during the recording of images is regularly reversed with respect to its direction during the life of the image-recording medium.

According to a first variant of the invention, a series of images are printed alternately, the image-recording electrodes being brought to a positive, or negative, potential with respect to the companion electrode in one series of images while in the following series of images they are brought to a potential which is the reverse of the potential applied in the preceding series.

The term "images" in this context denotes the information transferred to the same side of an image-receiving material. The number of images formed in consecutive series may be equal or differ and in each series is preferably not more than 10, in order to avoid excessively long unilateral loading of the image-recording medium.

According to a preferred embodiment of this variant, the potential is reversed for each image to be formed. Potential reversal can be obtained in various ways. For example, during the formation of a first image or a first series of images, the image-recording electrodes that are required to deposit toner on the dielectric surface are brought to a positive potential of 30–40 volts, for example, while the companion electrode and the image-recording electrodes not involved in image formation are at earth potential. During the formation of the next image or the next series of images, the image-forming image-recording electrodes are put at a negative potential of 30 to 40 volts while the companion electrode and image-forming electrodes not involved in image formation remain at earth potential or else the image-forming image-recording electrodes are put at earth potential while the companion electrode and the image-recording electrodes not involved in image formation are put at the same potential of about 30 to 40 volts.

According to a second variant of the invention, a high-frequency AC voltage is applied between the companion electrode and the image-forming electrodes not involved in image-formation, while the image-forming electrodes which are involved in image formation are put at a negative or positive potential (DC voltage), which may or may not be superimposed on the AC voltage already applied. The high-frequency AC voltage has a frequency such that the toner deposition on the image recording medium again remains below a predetermined level, in this case a level such that the print is visually free of background.

According to one attractive embodiment of this second variant, the high-frequency AC voltage is applied to the companion electrode while the image-forming electrodes, when not involved in image formation, are at earth potential and, when they do contribute to image formation, are put at a positive or negative potential or, as will be described in connection with the first variant, are brought alternately to negative and then positive potential.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
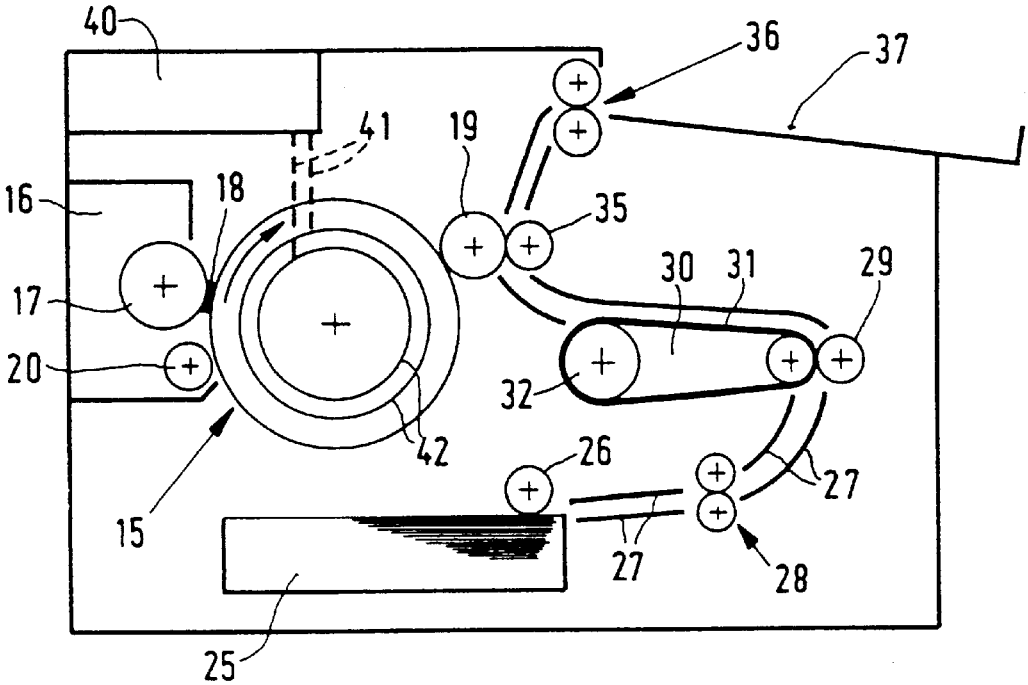
FIG. 1 diagrammatically illustrates an image-forming device according to the invention.

The image-forming device shown in FIG. 1 is provided with an image-recording medium 15 which will be described in detail hereinafter with reference to FIG. 2. The image-recording medium 15 passes through an image-forming station 16 wherein its surface is provided with a uniform layer of toner powder of a resistivity of about $10^5$ Ωm by member 20 constructed as described in U.S. Pat. No. 3,946,402.

The powdered surface of the image-recording medium 15 is then fed to an image-forming zone 18 where a magnetic roller 17 is disposed in close proximity to the surface of the medium 15 and comprises a rotatable electrically conductive shell and a stationary magnet system disposed inside the shell. The stationary magnet system comprises a ferromagnetic knife blade clamped between like poles of two magnets and is constructed as described in EP-A-0 304 983. By applying a voltage between one or more image-forming electrodes of the image-recording medium 15 and the magnetic roller shell acting as a companion electrode, a powder image is formed on the image-recording medium. By the application of pressure this powder image is transferred to a heated rubber-coated roller 19. A sheet of paper is taken from the supply stack 25 by a roller 26 and is fed via belts 27 and rollers 28 and 29 to a heating station 30. The latter comprises a belt 31 trained around a heated roller 32. The paper sheet is heated by contact with the belt 31. The sheet of paper thus heated is now passed between the roller 19 and the pressure roller 35, the softened powder image on the roller 19 being completely transferred to the sheet of paper. The temperatures of the belt 31 and the roller 19 are so adapted to one another that the image fuses to the sheet of paper. The sheet of paper provided with an image is fed via conveyor rollers 36 to a collecting tray 37.

Figure 2:
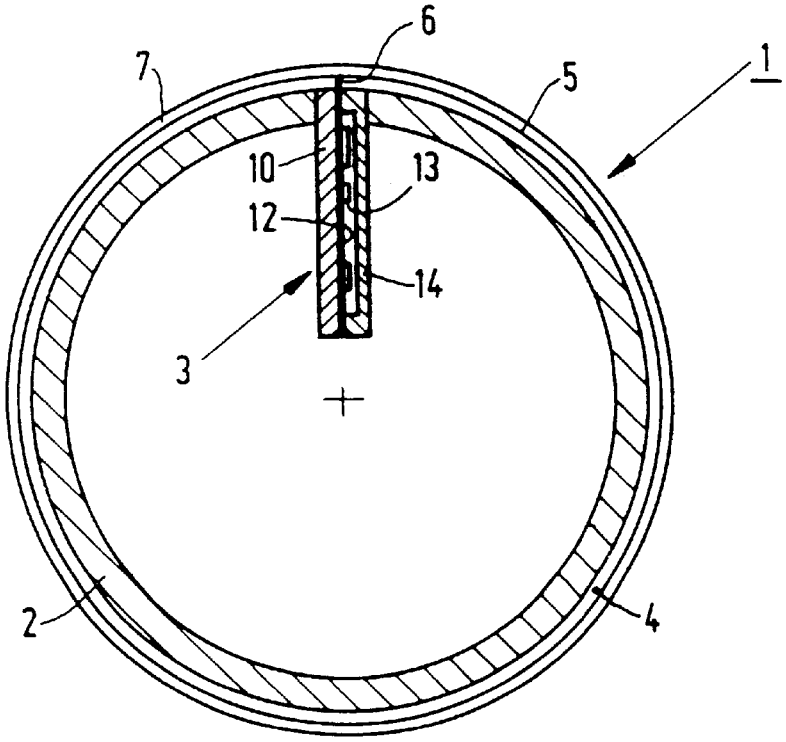
FIG. 2 is a section of an image-recording medium as used in the device shown in FIG. 1.

Unit 40 comprises an electronic circuit which converts the optical information of an original into electrical signals which are fed, via wires 41 provided with sliding contacts, and via conductive tracks 42 formed in the side wall of the image-recording medium 15, to control elements 3, see FIG. 2, connected to the tracks 42. The information is fed serially line by line to the shift register of the integrated circuits of the elements 3. If the shift registers are completely full in accordance with the information of one line, that information is set in the output register and the electrodes 6, 5, see FIG. 2, are energized or not via the drivers depending on the signal. While this line is being printed, the information of the next line is fed to the shift registers. Unit 40 also comprises the known control electronics for controlling, regulating and monitoring the various functions of the image-forming device.

Apart from optical information originating from an original, electrical signals originating from a computer or a data-processing device can be converted in unit 40 to signals fed to the control elements 3.

The image-recording medium 15 used in the image-forming device of FIG. 1 is shown in diagrammatic cross-section in FIG. 2. The image-recording medium 15 shown in FIG. 2 comprises a cylinder 2 having disposed therein an axially extending control element 3 with a construction to be described hereinafter. The cylinder 2 is covered with an insulating layer 4, on which image-forming electrodes 5 are disposed and extend in the form of endless tracks parallel to one another at substantially constant spacing from one another in the peripheral direction of the cylinder 2. Each image-forming electrode 5 is conductively connected to one control electrode 6 in each case of the control element 3. The number of control electrodes 6 of the control element 3 is equal to the number of image-forming electrodes 5, such number determining the quality of images to be formed on the image-recording element 1. The greater the electrode density, the better the image quality. In the embodiment used here, the number of electrodes 5 is 16 per millimeter, the electrodes 5 having a width of 40 μm and the inter-electrode distance being about 20 μm.

Finally, the pattern of image-forming electrodes 5 is covered with a smooth dielectric top layer 7 consisting of an approximately 0.8 micrometer thick layer of silicon oxide, the bottom layer portion thereof, in a thickness of about 0.4 micrometer, consisting of SiOx, where x=+/−0.5 and the top layer portion consists of SiOx where x=+/−1.5.

The silicon oxide layer is applied by a known sputter technique in a vacuum chamber, silicon being sputtered from a silicon target with argon and oxygen being introduced into the chamber and in the first phase of the sputter process the supply of oxygen is such that SiOx, x=+/−0.5 is applied and in the second phase the oxygen supply is increased so that SiOx, x=+/−1.5 is applied.

The control element 3 comprises a support 10 provided in a known manner with an electrically conductive metal layer, such as copper, the metal layer being converted to a conductive track pattern 12 in a known manner. The track pattern 12 consists, on the one hand, of the conductive connections between the various electronic components 13 of the control element 3 and, on the other hand, the control electrodes 6 are each conductively connected to one image forming electrode 5 in each case. Finally, the control element 3 also comprises a cover 14 connected in a manner known per se, e.g. gluing, to the support 10 so that a box-shaped control element 3 is formed, in which the electronic components are enclosed.

The electronic components 13 comprise a number of known integrated circuits (IC's) comprising a series-in parallel-out shift register, an output register, and drivers connected thereto with a voltage range of 25 to 50 volts. Each control electrode 6 is connected to a driver of one of the integrated circuits.

Figure 3:
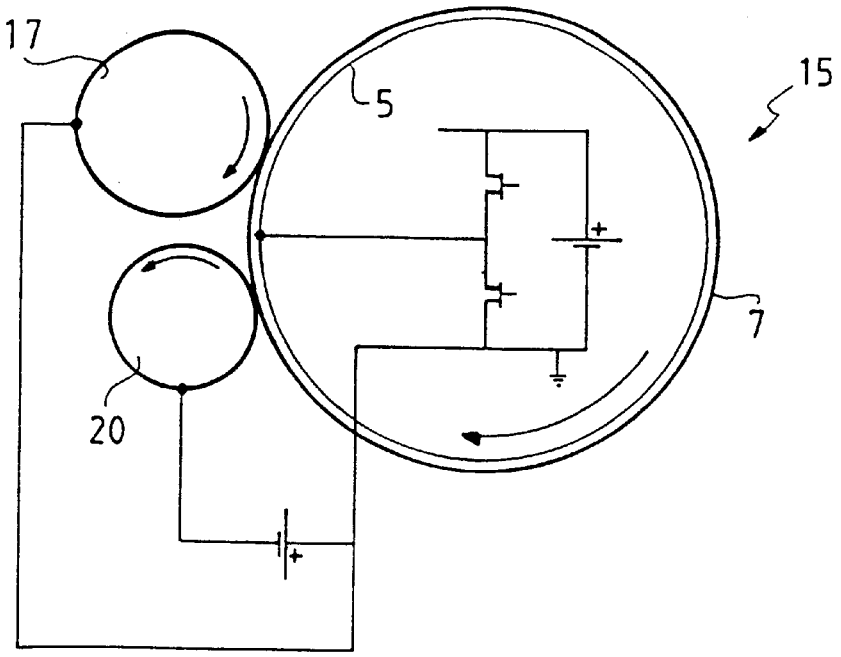
FIGS. 3 and 4 are diagrams showing the electrical circuit of the image-forming and companion electrodes in some embodiments of the invention.
Figure 4:
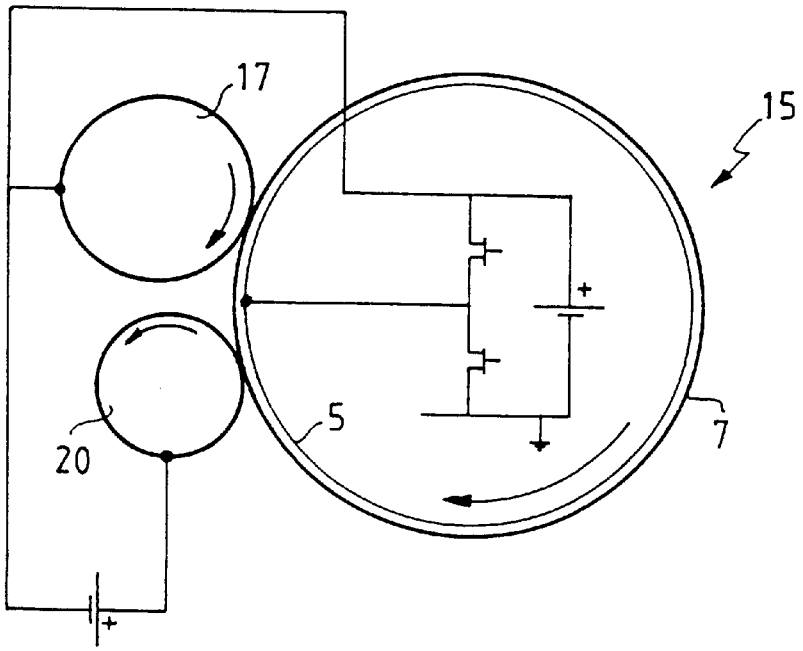

FIGS. 3 and 4 show two different possibilities of operation for the operative image-forming part of the device according to FIG. 1.

In the option shown in FIG. 3, the toner supply roller 20 is at a potential of −60 V while the shell of the magnetic roller 17 and the image-forming electrodes of the image-recording medium, when no image is being printed, are at earth potential. When an image is printed, the image-forming electrodes involved in image formation are at a potential of +40 V.

In the embodiment shown in FIG. 4, the toner supply roller 20 is at +100 V and the shell of the magnetic roller 17 and the image-forming electrodes 5 are switched to +40 V when no image is being printed. During image-formation, the involved image-forming electrodes 5 are at earth potential.

If the image-forming device is operated continuously in the embodiment as shown in one of FIGS. 3 or 4, the area free of background, which in the starting situation, with the image-forming medium still unused, is between approximately +4 and −4 V, is found to decrease relatively rapidly, and after about 300,000 prints of A4 format a situation is reached in which the area is only 0 to −4 V and prints free of background can no longer be obtained.

According to the first variant of the invention, one or a limited number of images, A4 format, are printed alternately in the situation shown in FIG. 3 and in the situation shown in FIG. 4. Switching the image-forming device from one situation to the other is controlled in a manner known per se by the unit 40 and takes place in the period between each two successive image-forming cycles. During switching over, the image-forming electrodes 5 and the shell 17 are simultaneously switched so that toner deposition on the image-forming medium is prevented. Since, in the situation shown in FIG. 4, image formation is effected by switching the image-forming electrodes 5 from +40 V to 0 V, the image data stored, for example, page-wise in an electronic memory are set in the output register of the drivers in an inverted form in comparison with the situation shown in FIG. 3. Electronic circuits for effecting switching over and inverting image data are known to one of ordinary skill in this area and are not therefore described in detail.

According to the invention, a considerable increase in the life of the image-recording medium is achieved. After 500,000 prints, the area free of background had in all cases dropped only 1–1.5 V and prints free from background were still obtained.

In one preferred embodiment of the invention, in which after each image is printed the situation is switched from one situation to the other, the background-free area after one million prints was still +2 to −3 V and the prints were thus still background-free.

According to the invention it is important that the image-recording medium 15 should not be exposed excessively to a constant-orientation electric field. The maximum number of images that may be printed successively in the same printing situation cannot be indicated exactly. It was established that there is always a considerable increase in life if the number of images, A4 format, printed successively in the same situation is less than 10. If the drivers used to switch the image-forming electrodes 5 enable both a positive and negative potential to be switched to the image-forming electrodes, e.g. +40 V and −40 V, the method according to the invention can also be performed by printing one or more images alternately with the image-forming electrodes being brought to the positive, or negative, voltage and then one or more images with the image-forming electrodes 5 at a negative, or positive, voltage. The shell 17 acting as the companion electrodes is in that case always at earth potential.

On reversal of the electrical field, as shown in FIGS. 3 and 4, the voltage at the toner supply roller 20 is in each case switched from a negative potential to a positive potential or vice versa. The switching over of this voltage also appears to have a favorable effect on the image-recording medium life. Another reason for switching over the voltage to the toner supply roller 20 is that in that case, even if the image-forming electrodes 5 are energized to form an image, the voltage difference between the toner supply roller 20 and the image-recording medium is large enough to deposit a sufficient quantity of toner powder on the image-recording medium surface. If the voltage at the supply roller 20 were not reversed, there would be a risk, when large image areas are required to be printed, of the toner supply being inadequate and the supply of toner in the image-forming zone being exhausted.

In order to investigate the effect of reversing just the voltage at the supply roller 20 on the life of the image-recording medium 5, images were printed in the situation shown in FIG. 3, in which the voltage at the supply roller 20 was always reversed in the period between two successive images. No background-free prints could be obtained after approximately 400,000 images.

According to the second variant of the invention, a high-frequency AC voltage is applied between at least those image-forming electrodes which are not involved in image formation and the shell 17. The frequency of this AC voltage is selected to be such that no toner powder is deposited on the image-recording medium 15 if the image-forming electrodes 5 are not energized to form an image. In this variant of the invention, in comparison with the variants described hereinbefore, it was found that in the starting situation, i.e. with the image-recording medium still unused, the background-free area was considerably larger than in the previously described starting situations.

The size of the background-free area depends on the frequency, amplitude and signal shape of the AC voltage. For example, with a block voltage having peak values of +40 V and −40 V, a background-free area was found from frequencies of about 6 kHz. The maximum size of the background-free area is obtained with a frequency somewhere between 15 and 25 kHz. On application of a block voltage with peak values of +80 V and −80 V, a background-free area was found at much higher frequencies, the optimum always being achieved at a frequency between 100 and 200 kHz. The optimal AC voltage frequency can be readily determined experimentally for a given device and a given toner powder. The AC voltage may be of any required shape. Preferably, a block voltage is used. The amplitude of the AC voltage is at least 25 V and is preferably between 25 and 100 V.

In a printing device of the type as described with reference to FIG. 3 in which a stationary magnet system was again disposed inside the shell 17 as described hereinafter with reference to FIG. 5, a background-free area of +7 to −8 V was determined using the magenta-colored toner powder described hereinafter, by application to the shell 17 of a block voltage with a frequency of 160 kHz and peak values of +80 and −80 V, respectively. Image recording in these conditions was obtained by switching the image-forming electrodes 5 between +40 V, when an image pattern is recorded, and earth potential when no image is recorded. When the shell 17 was connected to earth, the background-free area was +4 V to −5 V.

Apart from the larger background-free base, resulting in a longer life of the image-recording medium, images having a relatively sharper image edge were recorded on application of the AC voltage to the shell 17, particularly towards the end of the life of the image-recording medium 15, as compared with the situation in which no AC voltage is applied. The greater image edge sharpness applies particularly to image rear edges as considered in the opposite direction to the direction of transport of the image-recording medium.

Figure 5:
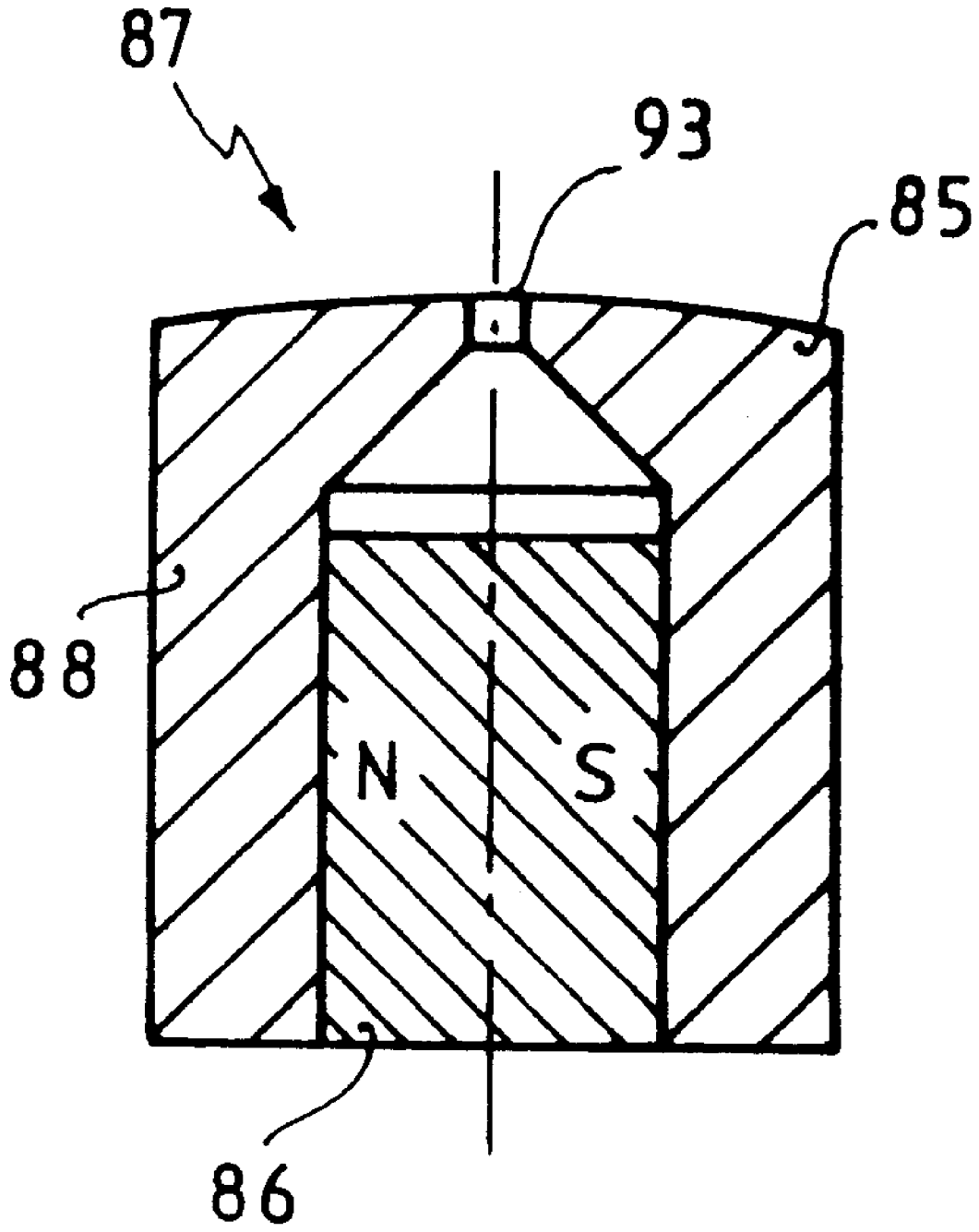
FIG. 5 is a cross-sectional view of a magnet used in the present invention.

The magnet system 87 shown in FIG. 5 comprises a permanent magnet 86 consisting of an alloy of neodymium, iron and boron. Magnetizable elements 85 and 88 are secured against the poles of a magnet 86 and the ends not connected to the magnet 86 terminate in a gap 93 and gradually narrow in the direction of the gap 93. The magnet 86 together with the magnetizable elements 85 and 88 is so dimensioned that the ends of the elements 85 and 88 leading into the gap 93 are magnetically saturated. The magnetizable material of the elements 85 and 88 is iron cobalt which has a high saturation magnetization and a high permeability.

The magnet system 87 is so disposed inside the shell 17 that the gap 93, which has a width of 300 micrometers, is situated in the center of the image-forming zone and the inside of the shell 17 just does not touch the magnetizable elements 85 and 88. A more detailed description of the magnet system 87 is provided in European Patent Application No. 0 573 096.

The toner powder used had the following composition:

thermoplastic polyester resin type Atlac 500T, made by ICI, England, derived from oxypropylene bisphenol A and fumaric acid;

1 percent by volume of carbonyl iron having a particle size of about 2 micrometers, BASF, Germany, type HS;

3% by weight of red dye, Basonyl Rot 560—C.I. Basic Violet 11:1, in the perchlorate form; and a resistivity of about $10^5$ Ωm obtained by coating the powder particles, which were of a size between 11 and 20 micrometers, with fluorine-doped tin oxide in the manner described in European Patent Application No. 0 441 426.

The larger background-free area obtained by applying a high-frequency AC voltage to the shell 17 can also be used to improve the quality of the images recorded on the image-recording medium 15. For example, in a situation in which, without using AC voltage, there is a background-free area from +4 to −4 V, using a toner powder with a particle size of 11–20 micrometers and, with the application of the correct AC voltage, a background-free area from +7 to −7 V is obtained. A new situation is achieved with a better image quality by using a finer toner powder with, for example, a particle size of 7–14 micrometers, an acceptable background-free area being obtained of +5 to −5 V, for example, due to the application of an AC voltage to shell 17.

The embodiment in which a high-frequency AC voltage is applied to the shell 17 can advantageously be combined with the above-described embodiment in which, during image recording, the image-forming electrodes 5 are alternately at positive and then negative voltage. The life of the image-recording medium 15 has been found to be lengthened more as a result, while the larger background-free area obtained by applying AC voltage is also achieved. For example, the method according to the invention can advantageously be performed by applying to the shell 17 a high-frequency AC voltage having peak values of +40 V and −40 V, with a frequency which, in the given specific arrangement and the given toner powder, results in the largest background-free area, and by energizing the image-forming electrodes, as described hereinbefore with reference to FIGS. 3 and 4, at +40 V during the image formation and then alternately at −40 V. The switching over of the potential can again be effected per image or groups of images as already described hereinbefore.

Although the embodiment in which AC voltage is applied has been illustrated above in connection with the application of AC voltage to the shell 17, it will be clear that the AC voltage can also be applied to the image-forming electrodes 5, the latter being switched between AC voltage with peak values of, for example, + and −40 V, when they are not involved in image formation, and a positive or negative voltage of 40 V when they are so involved, whether this positive or negative voltage is superimposed on the AC voltage. The shell 17 is then always at earth potential.

The AC voltage can be applied to the image-forming electrodes 5 or the shell 17 not just during image recording, but also in periods in which the printing device is in the standby position. Alternatively, in the latter periods, a constant potential can be applied to the image-forming electrodes 5 and the shell 17, e.g. earth potential or a positive or negative voltage of 40 volts for example. A combination of the two is possible, e.g. a situation in which in the standby position there is predominantly a constant voltage applied between the image forming electrodes 5 and the shell 17 with short breaks of a few seconds in which AC voltage is applied to the image-forming electrodes 5 or the shell 17 and the other electrodes, 17 or 5, are at each potential. The switching over of the voltage, e.g. from +40 to −40 V or vice versa, applied to the image-forming electrodes 5 can also take place, not only between consecutive images or groups of images, as indicated in the embodiments described above, but also during the recording of the same image. Thus each image-forming electrode, when triggered to contribute to image recording after the interruption of one or more image lines in which it was not involved in image recording, can be put at a potential which is the opposite to the potential applied when the electrode in question was last involved in image formation. Having regard to the life of the image-recording medium 15, the result obtained in this way is practically the same as the result obtained when switching over of the applied voltage takes place per image. Since the implementation of this variant requires a more complex control circuit than for the variant in which switching is carried out between successive images, the latter variant is preferred.

It will also be clear that the method according to the invention can also be performed in image-forming devices in which the companion electrode is situated beneath the dielectric surface of the image-recording medium and the image-forming electrodes are disposed in the image-forming zone at a short distance above the dielectric surface. An image-forming device of this kind is described, for example, in U.S. Pat. No. 3,946,402.

The method according to the invention can be used not only with toner powders having an electrically conductive surface coating consisting, for example, of carbon, a doped metal oxide such as tin oxide doped with fluorine or antimony, or a conductive polymer such as protonized polyaniline complex, such as known from WO 92/22911, but also with electrically conductive toner powders which have obtained their conductivity by electrically conductive material, e.g. the above-mentioned protonized polyaniline complexes, being distributed over the volume of the toner particles. A toner powder of this kind can be obtained, for example, by melting 100 g of polyester resin as described above, then distributing 11 g of protonized complex of polyaniline emeraldine and camphor sulphonic acid, prepared in accordance with the instructions of Examples 1 and 3 of WO 92/22911, in the melt and then 33 g of magnetizable pigment, type Bayferrox B318 made by Bayer AG, Germany. The homogeneous melt is then cooled to a solid mass and ground and screened to give particles having a particle size of between 10 and 20 micrometers. The powder image formed with such toner powder on an image-recording medium 15 can then be transferred by pressure to a sheet of paper or other receiving material and then fixed thereon by heating, e.g. using (weak) magnetron radiation. Of course, other fixing methods known per se can be used.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of recording images on an image-recording medium and having a dielectric surface, which method comprises the step of applying, in accordance with an image pattern to be recorded, a voltage between a set of image-recording electrodes and a companion electrode, either one of the set of image-recording electrodes and the companion electrode being situated beneath the dielectric surface and an other one of the set of image-recording electrodes and the companion electrode being situated a distance above the dielectric surface, the applied voltage causing toner powder situated in the space between the dielectric surface and the electrode disposed thereabove, to be deposited onto the dielectric surface in accordance with the image pattern to be recorded, wherein the improvement comprises the steps of:

(a) applying a first voltage of a first orientation between the image-recording electrodes and the companion electrode to effect image recording; and then (b) applying a second voltage of a second orientation opposite and substantially equal to said first voltage of said first orientation between the image-recording electrodes and the companion electrode, wherein the second voltage is of opposite orientation relative to the first voltage.

2. The method according to claim 1, wherein the companion electrode is kept at a fixed voltage and the image-forming electrodes, when said image forming electrodes contribute to image formation, are brought alternately to a positive and to a negative voltage with respect to the companion electrode.

3. The method according to claim 1, wherein each of the companion electrode and the image-forming electrodes are switched between the first voltage and the second voltage.

4. The method according to claim 1, wherein, during steps (a) and (b), a high-frequency AC voltage is applied between the companion electrode and the image-forming electrodes.

5. The method according to claim 4, wherein the AC voltage is applied to the companion electrode and the image-forming electrodes are switched between earth and a DC voltage.

6. The method according to claim 5, wherein the DC voltage applied to the image-forming electrodes is alternately positive and negative.

7. The method according to claim 1, wherein image recording is also effected during step (b), and a number of images recorded during step (b) is equal to a number of images recorded during step (a).

8. The method according to claim 7, wherein one image is recorded during each of steps (a) and (b).

9. The method according to claim 1, wherein image recording is also effected during step (b), and a number of images recorded during step (b) is different from a number of images recorded during step (a).

10. An image-forming device comprising:

an image-recording medium with a dielectric surface, the dielectric surface including an image-forming zone situated between a set of individually, separately energizable image-forming electrodes and a companion electrode, either one of the set of image-recording electrodes and the companion electrode being situated beneath the dielectric surface and the other one of the set of image-recording electrodes and the companion electrode being situated a distance above the surface; and a controller for (1) energizing the image-forming electrodes in accordance with an image pattern to be recorded on the dielectric surface using image pattern toner powder supplied to the image-forming zone and (2) switching the image-forming electrodes between a positive and a negative potential of a substantially same value with respect to the companion electrode.

11. The image-forming device according to claim 9, wherein the controller applies a high-frequency AC voltage to at least one of the companion electrode and the image-forming electrodes.

12. The image-forming device according to claim 10, and further comprising:

toner supply means disposed adjacent to the image-forming zone for applying a layer of toner powder to the image-recording medium, by an electrical field applied between the toner supply means and the image-recording medium; and a switch for reversing a direction of the electrical field between the toner supply means and the image-recording medium.

13. An image-forming device comprising:

an image-recording medium with a dielectric surface, the dielectric surface including an image-forming zone situated between a set of individually, separately energizable image-forming electrodes and a companion electrode, either one of the set of image-recording electrodes and the companion electrode being situated beneath the dielectric surface and the other one of the set of image-recording electrodes and the companion electrode being situated a distance above the surface;

toner supply means confronting the image-forming zone for applying a layer of toner powder to the image-recording medium, under the influence of an electrical field applied between the toner supply means and the image-recording medium;

a controller for energizing the image-forming electrodes in accordance with an image pattern to be recorded in order to deposit toner powder on the dielectric surface in accordance with the image pattern; and a switch for reversing the direction of the electrical field between the toner supply means and the image-recording medium.

* * * * *

UNITED STATES PATENT AND TRADEMARK OFFICE

CERTIFICATE OF CORRECTION

PATENT NO. : 6,040,847
DATED : March 21, 2000
INVENTOR(S) : Mike Paul van Eekhout et al.

It is certified that error appears in the above-identified patent and that said Letters Patent is hereby corrected as shown below:

Title page,
Item "[73] Assignee:", please change "OCE-Nederland B.V., Ma Venlo, Niger" to -- OCE-Nederland B.V., Ma Venlo, The Netherlands --.

Signed and Sealed this

Twentieth Day of November, 2001

*Attest:*

Nicholas P. Godici

*Attesting Officer*

NICHOLAS P. GODICI
*Acting Director of the United States Patent and Trademark Office*